US010645503B2

(12) United States Patent
Freels et al.

(10) Patent No.: US 10,645,503 B2
(45) Date of Patent: May 5, 2020

(54) METHOD FOR PRODUCING A HOUSING PART OF A HEARING DEVICE, HOUSING PART FOR A HEARING DEVICE AND HEARING DEVICE

(71) Applicant: SIVANTOS PTE. LTD., Singapore (SG)

(72) Inventors: Bjoern Freels, Erlangen (DE); Daniela Beck, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/029,787

(22) Filed: Jul. 9, 2018

(65) Prior Publication Data

US 2019/0014427 A1 Jan. 10, 2019

(30) Foreign Application Priority Data

Jul. 7, 2017 (DE) ..... 10 2017 211 668

(51) Int. Cl.
*H04R 25/00* (2006.01)

(52) U.S. Cl.
CPC ..... *H04R 25/658* (2013.01); *H04R 25/652* (2013.01); *H04R 2225/025* (2013.01)

(58) Field of Classification Search
CPC . H04R 2225/025; H04R 25/652; H04R 25/65
USPC ..... 381/322, 328, 318
See application file for complete search history.

(56) References Cited

U.S. PATENT DOCUMENTS

| | | | | |
|---|---|---|---|---|
| 8,744,107 | B2 | 6/2014 | Meister et al. | |
| 2004/0017922 | A1* | 1/2004 | Bachler | H04R 25/658 381/322 |
| 2008/0317269 | A1* | 12/2008 | Tipsmark | H04R 25/658 381/322 |
| 2016/0023146 | A1* | 1/2016 | Hampton | D04H 1/425 210/510.1 |
| 2016/0373868 | A1* | 12/2016 | Karamuk | H04R 25/652 |

FOREIGN PATENT DOCUMENTS

| | | | |
|---|---|---|---|
| CA | 2432374 | A1 | 1/2004 |
| DE | 102011006563 | B3 | 5/2012 |
| EP | 1385355 | A1 | 1/2004 |

* cited by examiner

*Primary Examiner* — Alexander Krzystan
(74) *Attorney, Agent, or Firm* — Laurence A. Greenberg; Werner H. Stemer; Ralph E. Locher

(57) ABSTRACT

A method for producing a housing part of a hearing device. The housing part serves to receive electronic components of the hearing device in a housing interior. Fibers are used to build up a fiber skeleton for a wall of the housing part at least partially surrounding the housing interior. A mechanical property of the wall is varied in a predefined manner along a reference direction of the housing part by way of the fibers. The fiber skeleton is then infiltrated, at least over part of its longitudinal extent, with a matrix material. There is also described a housing part of a hearing device and a hearing device with a housing part formed with fibers.

13 Claims, 2 Drawing Sheets

METHOD FOR PRODUCING A HOUSING PART OF A HEARING DEVICE, HOUSING PART FOR A HEARING DEVICE AND HEARING DEVICE

CROSS-REFERENCE TO RELATED APPLICATION

This application claims the priority, under 35 U.S.C. § 119, of German patent application DE 10 2017 211 668.4, filed Jul. 7, 2017; the prior application is herewith incorporated by reference in its entirety.

BACKGROUND OF THE INVENTION

Field of the Invention

The invention relates to a method for producing a housing part of a hearing device. The invention further relates to such a housing part, and moreover also to a hearing device having such a housing part.

A hearing device usually serves to output acoustic signals to the ear of a wearer of this hearing device. For this purpose, such a hearing device usually comprises an output transducer, which is in most cases configured as a loudspeaker (also referred to as a receiver). This output transducer is usually surrounded by a housing part of the hearing device, for example by a housing shell or the like, in order to protect the output transducer from environmental influences and/or in order to permit a defined orientation of the output transducer, for example in the auditory canal of the wearer of the hearing device. Such a hearing device may, for example, take the form of a headset, headphones, so-called (in ear) wearables, tinnitus maskers or the like.

However, hearing devices often also serve to provide persons suffering from impaired hearing with (often wearer-specifically) amplified and/or filtered acoustic signals in order to compensate at least partially for the existing hearing loss. In that case, such a hearing device is also referred to as a hearing aid. Particularly in the case of a hearing aid, the hearing device usually also comprises an input transducer, mostly in the form of a microphone for detecting ambient noises, and a downstream signal processor (also called a controller) for processing (filtering and/or amplifying) signals generated from the ambient noises and for outputting these processed signals to the output transducer. Depending on the nature of the hearing loss, the output transducer of hearing aids can also be configured as a bone conduction receiver or cochlear implant for the mechanical and/or electrical stimulation of the auditory system of the wearer.

Moreover, in the case of hearing aids, different designs can also be used. In so-called behind-the-ear (BTE) hearing aids, the at least one microphone, the signal processor and an energy source are arranged in a housing (part) that is to be worn behind the pinna. The output transducer can likewise be arranged in this housing (part) and is in this case connected to the auditory canal of the wearer by means of a sound tube. Alternatively, the loudspeaker can also be arranged in a dedicated housing part (often referred to as an earpiece) and can be connected by a signal line to the components arranged in the actual hearing aid housing. Moreover, hearing aids referred to as in-the-ear (ITE) hearing aids are also used, which have a housing that contains the electronic components and that is to be worn wholly or partially in the auditory canal. Depending on the design of such an in-the-ear hearing aid, the outer contour of the hearing aid is adapted individually to the auditory canal or is designed to be adaptable to a large number of different auditory canal shapes via flexible, stopper-like earpieces (also referred to as domes). To permit the individual adaptation, an impression of the individual auditory canal is usually taken and is copied, for example, by means of generative methods (3D printing, stereolithography and the like). The housing parts thus formed, and also referred to as ear shells, are produced from a comparatively stiff material. If a high amplification effect of the loudspeaker is required, the latter additionally has to be supported via flexible damping materials (particularly in order to reduce feedback to the microphone caused by structure-borne noise), such that the required installation space in most cases increases.

SUMMARY OF THE INVENTION

It is accordingly an object of the invention to provide a method for producing a housing component for a hearing device and a hearing device which overcome the above-mentioned and other disadvantages of the heretofore-known devices and methods of this general type and which provides, simply, for an improved housing part for a hearing device.

With the foregoing and other objects in view there is provided, in accordance with the invention, a method of producing a housing part of a hearing device, the housing part having a housing interior for receiving at least one electronic component of the hearing device. The method comprises:

providing fibers and building up a fiber skeleton for a wall of the housing part at least partially surrounding the housing interior;

varying a mechanical property of the wall in a predefined manner along a reference direction of the housing part by way of the fibers; and infiltrating the fiber skeleton with a matrix material, at least over a portion of a longitudinal extent thereof.

The method according to the invention serves for producing a housing part of a hearing device, preferably a housing part to be worn in the auditory canal of a person (referred to below as the wearer). The housing part serves to receive at least one electronic component of the hearing device in a housing interior. In the method, fibers (alternatively also referred to as filaments) are used to build up a fiber skeleton for a wall of the housing part at least partially surrounding the housing interior. A mechanical property of the wall (preferably to be produced in a subsequent method step) varies in a predefined manner along a reference direction of the housing part by means of the fibers. That is to say, in the finished state, the wall of the housing part has a varying mechanical property over its extent along the reference direction. The fiber skeleton is then infiltrated with a matrix material (in particular to form the wall), at least over part of its longitudinal extent (preferably extending along the reference direction).

Here and in the following, the term "reference direction" is understood in particular as a direction along which a (sur)face of the housing part extends, in particular a (sur) face predefined by the wall or by the fiber skeleton. A longitudinal extent of the housing part preferably runs in this reference direction. It is therefore in particular not the thickness direction of the wall or of the fiber skeleton. Particularly in the case of the housing part to be worn in the auditory canal, the reference direction is particularly preferably an insertion direction of the housing part into the auditory canal. In this case, "insertion direction" is to be understood in particular as the direction along which the housing part, specifically the finished hearing device, is intended to be inserted into the auditory canal of the wearer.

The method according to the invention advantageously affords a possibility of reducing the number of individual parts needed for a hearing device and of reducing the installation space and the assembly work. This is achieved in particular by the fact that the functions of different structures of conventional hearing devices, in particular of individual and separate components that have mechanical properties differing from each other in order to meet their respective purposes, are integrated in one common component, namely the above-described housing part.

The housing part according to the invention for the hearing device is produced by means of the method described here and in the following.

The hearing device according to the invention comprises the housing part described above and thus produced by the method according to the invention.

The advantages of the method according to the invention thus also pertain to the housing part and to the hearing device comprising the latter.

In a particularly preferred embodiment, a mechanical property, in particular a flexibility of the wall, varies in a predefined manner. In other words, the fiber skeleton is built up in such a way that, in the (final) finished state of the housing part, the wall has a deliberately varying stiffness (i.e. different stiffness values). In this way, for example, a single housing part can have regions with an increased stiffness (i.e. an increased stiffness value) for mounting components (for example further housing parts and/or electronic components) and other regions which, by virtue of having a particularly low stiffness (i.e. a low stiffness value), permit a particularly comfortable adaptation to the auditory canal of the wearer (i.e. are able to conform to the auditory canal). In the final finished state as intended, the wall thus has a flexibility that varies along the reference direction, in particular the insertion direction.

In a further embodiment also conceivable within the context of the invention, the mechanical property varying in a predefined manner (in addition to or as an alternative to the flexibility) is a compressibility of the wall.

In an expedient development, the flexibility of the wall increases in a predefined manner in particular in the insertion direction. That is to say, in the finished state, the wall has a higher flexibility (or lower stiffness) in the region of its leading end in the insertion direction than it does at its trailing end in the insertion direction. The profile of the flexibility (or also stiffness) can be continuous and/or can be configured with at least one more or less pronounced change of stiffness (i.e. a step-like change). The region with the lowest stiffness or highest flexibility (hereinafter also referred to as the "flexible region") is preferably configured in such a way that an elastic deformation is possible by hand without applying any particular force. The region with the highest stiffness is preferably configured in such a way that such elastic deformation (by hand) is not possible or, compared to the flexible region, is possible only by applying significantly increased force and/or is possible only to an inappreciable extent.

In a further expedient embodiment, in order to predefine the mechanical properties of the wall, the fiber skeleton is built up so as to vary in terms of its geometric structure and/or its density. The geometric structure is understood as, on the one hand, structural features expressed in external dimensions, e.g. wall thickness, ribs, beads and the like, and on the other hand "inner structural features", in particular an orientation of the fibers inside the fiber skeleton. In the latter case, the fibers are for example oriented in such a way that they are able to take up much of the force acting on the wall during use, or alternatively such that these forces act transversely with respect to the fibers, such that an amplification effect is relatively low. In order to vary the density of the fiber skeleton, the number of fibers extending within a volume element of the fiber skeleton differs in a predefined manner.

In a preferred embodiment, an elastomer, particularly a cross-linkable elastomer, is used as the matrix material. The matrix material is thus a material with comparatively high elasticity and flexibility and is strengthened by means of the fiber skeleton to give locally different stiffness values. This elastomer is preferably a silicone (specifically a polyorganosiloxane), rubber or the like. In the non-crosslinked state, the elastomer used preferably has a sufficiently low viscosity to permit infiltration of the fiber skeleton as far as possible without inclusion of air bubbles. The fiber skeleton is infiltrated using methods such as immersion or by a pressure difference comparable to resin injection methods in which the matrix material is sucked in by means of underpressure or injected by means of overpressure. The matrix material, in particular the elastomer, is preferably also hardened (i.e. crosslinked) after the infiltration.

It is also conceivable in principle, within the context of the invention, that a thermoplastic elastomer be used.

The fiber skeleton is preferably infiltrated in such a way that the resulting wall is closed, i.e. does not have open pores or channels running through it. The wall is thus preferably impervious to the passage of contaminants or moisture.

In a further preferred embodiment, the material for the fibers of the fiber skeleton is a thermoplastic, in particular a polyamide or a polyether block amide. Alternatively, it is also possible to use other thermoplastics, for example polyester.

In a particularly expedient embodiment, the fiber skeleton is built up by means of electro spinning. Under the action of an electric field, a number of fibers are drawn from a polymer solution and applied to a counter-electrode, particularly in the form of a kind of woven fabric. In one variant, the formed fibers are placed on a mold core (also referred to as a target) which predefines the subsequent geometry of the fiber skeleton. In an alternative variant, the fibers are applied without such a mold core, comparably to a 3D printing method, and "layered" to form the fiber skeleton. The variation in the properties of the fiber skeleton (i.e. in particular of the geometric structure and/or the density) is obtained through a targeted change of the movement and/or speed of movement of the mold core and/or of the spinning head (from which the fibers are drawn off), the size of the mold core, a change of the electric field or the like. A variation of the properties of the skeleton and thus of the mechanical properties of the subsequent wall of the housing part can thus be adjusted in a particularly simple manner, advantageously also individually, i.e. specific to the wearer. In addition, by means of electro spinning, continuous transitions between regions of different flexibility (i.e. different stiffness values) can be obtained in a particular simple manner.

In an alternative embodiment, the fiber skeleton is built up from a woven and/or nonwoven (fibrous) semi-finished product, i.e. in particular from a woven fabric, scrim, nonwoven fabric or the like. For example, additional shaping methods are used for these semi-finished products, e.g. thermoforming. The variation in the mechanical properties is here preferably obtained by the use of different semi-finished products that vary, for example, in terms of their density, their material strength and/or their fiber orientation. In this case, compared to electrospinning, the stiffness profile of the wall has clearly pronounced transitions (i.e. in particular step-like transitions) between regions of different stiffness values.

In a further expedient embodiment, particularly in the infiltration of the fiber skeleton with the matrix material, an end of the fiber skeleton is kept free of the matrix material, said end lying counter to the reference direction (i.e. the end trailing in the insertion direction) and forming an annular edge around the housing interior. At this end, therefore, the fibers of the fiber skeleton are free and are not embedded in the matrix material.

In a further method variant for forming the "overall housing", the housing interior of the housing part is closed with a cover plate (also referred to as a faceplate in the case of an in-the-ear hearing aid) at the end of the housing part kept free of matrix material. This cover plate is expediently secured to the wall by means of an adhesive in such a way that the adhesive penetrates into the fiber skeleton kept free of the matrix material and thus, in addition to an adhesive (cohesive) connection, also catches in the fiber skeleton and thus additionally provides a form-fit connection to the housing part. This permits a particularly stable attachment of the cover plate. The invention thus also relates to a method for producing the hearing device with the above-described housing part. In the context of the hearing device, the cover plate is thus preferably connected to the housing part in the manner described above.

As has already been described, the above-described invention permits the formation of a housing part, in particular of a hearing aid housing, which has varying mechanical properties at least in some regions. The end of the housing part protruding into the auditory canal preferably has a particularly flexible configuration, such that, on the one hand, it is able to conform to the auditory canal and, on the other hand, it also provides a damped attachment structure (or bearing) for a loudspeaker, especially when particularly high noise levels are required.

In a particularly preferred embodiment, the housing part produced according to the method described above constitutes the sole shell delimiting the hearing device components with respect to the auditory canal. Alternatively, it is however also conceivable, within the context of the invention, that a kind of inner housing is pushed into the above-described housing part in order to mount hearing aid components. Such an inner housing is in particular a "frame part" produced from a comparatively stiff plastic, for example a polyamide, an ABS (acrylonitrile-butadiene-styrene copolymer) or comparable plastics.

The conjunction "and/or" is to be understood here and in the following as meaning that the features linked by means of this conjunction can be configured either together (in combination) or also as alternatives to one another. That is, "A and/or B" means A alone, B alone, or A and B in combination.

Other features which are considered as characteristic for the invention are set forth in the appended claims.

Although the invention is illustrated and described herein as embodied in a method for producing a housing part of a hearing device, housing part for a hearing device, and hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Parts corresponding to each other are always provided with the same reference signs in all the illustrative embodiments.

DETAILED DESCRIPTION OF THE INVENTION

Figure 1:
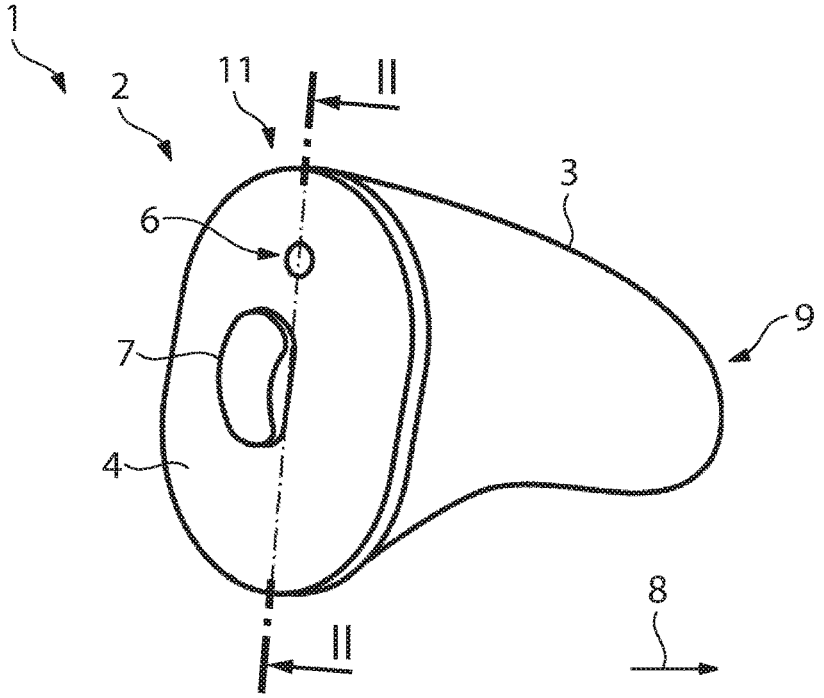
FIG. 1 shows a schematic perspective view of a hearing device.

Referring now to the figures of the drawing in detail and first, particularly, to FIG. 1 thereof, there is shown a hearing device 1, specifically an in-the-ear hearing aid. In order to accommodate electronic hearing aid components (illustrated only schematically in FIG. 3). The hearing aid 1 comprises a housing 2 which is formed substantially of a first housing part 3 and a second housing part 4. As can be seen from FIG. 2, the first housing part 3 forms a component that circumferentially surrounds a housing interior 5 and that is also referred to as an ear shell. The second housing part 4 is also referred to as a faceplate and forms a cover plate with which the housing interior 5 is closed off at one end with respect to the housing part 3. The second housing part 4 has, among other things, a microphone opening 6 for detecting ambient noises by means of the microphone M in the housing interior 5, and also a battery compartment door 7 for the reversible mounting and positioning of the hearing aid battery BAT. The hearing aid 1 has an outer contour that tapers along a reference direction, specifically an insertion direction 8, along which the hearing aid 1 is intended to be pushed into an auditory canal of a wearer. At a tip end 9 leading in the insertion direction 8, the first housing part 3 has a (schematically indicated) sound outlet opening 10 through which airborne sound, generated by the loudspeaker S that is disposed in the housing interior 5, is forwarded in the direction of the eardrum when the hearing aid is being worn as intended in the auditory canal of the wearer. At the rear end 11 directed away from the tip end 9, counter to the insertion direction 8, the second housing part 4 or faceplate is fitted onto the edge 12 of the first housing part 3 and is connected thereto by an adhesive connection.

In the insertion direction 8, i.e. in the direction from the rear end 11 or the edge 12 to the tip end 9, the first housing part 3 has an increasing flexibility, i.e. decreasing stiffness values. The first housing part 3 is soft and flexible in the region of the tip end 9, in such a way that it is able to conform to the contour of the auditory canal in this region and at the same time can also serve as a damping element for the loudspeaker S that is positioned in this region inside the housing interior 5.

To achieve this variation in the mechanical properties of the first housing part 3, i.e. the increasing flexibility of the housing part 3 in the insertion direction 8, specifically the increasing flexibility of its wall 14, the housing part 3 is configured as a fiber composite structure. To produce the housing part 3, a fiber skeleton (for the subsequent wall 14) is first of all built up from fibers 20. The material used for these fibers 20 is a thermoplastic, specifically a polyamide. To form the fiber skeleton, the fibers are deposited on each other by means of electrospinning with, as is indicated schematically in FIG. 2, a density that decreases in the insertion direction 8, i.e. specifically with a weight-related and/or volume-related fiber content that decreases in relation to the finished housing part 3. Thereafter, the fiber skeleton and therefore the fiber interstices lying between the fibers 20 are infiltrated with a matrix material, i.e. filled by wetting of the fibers 20. The wall 14 here is tight, i.e. is not designed with air inclusions or free spaces passing through it (or "sponge-like"). The matrix material 22 used is a crosslinkable silicone which sets, i.e. is crosslinked, after the infiltration of the fiber skeleton. The matrix material 22 thus has a sufficiently low viscosity for the infiltration of the fiber skeleton and, in the crosslinked state, it has a sufficiently low flexibility.

Figure 2:
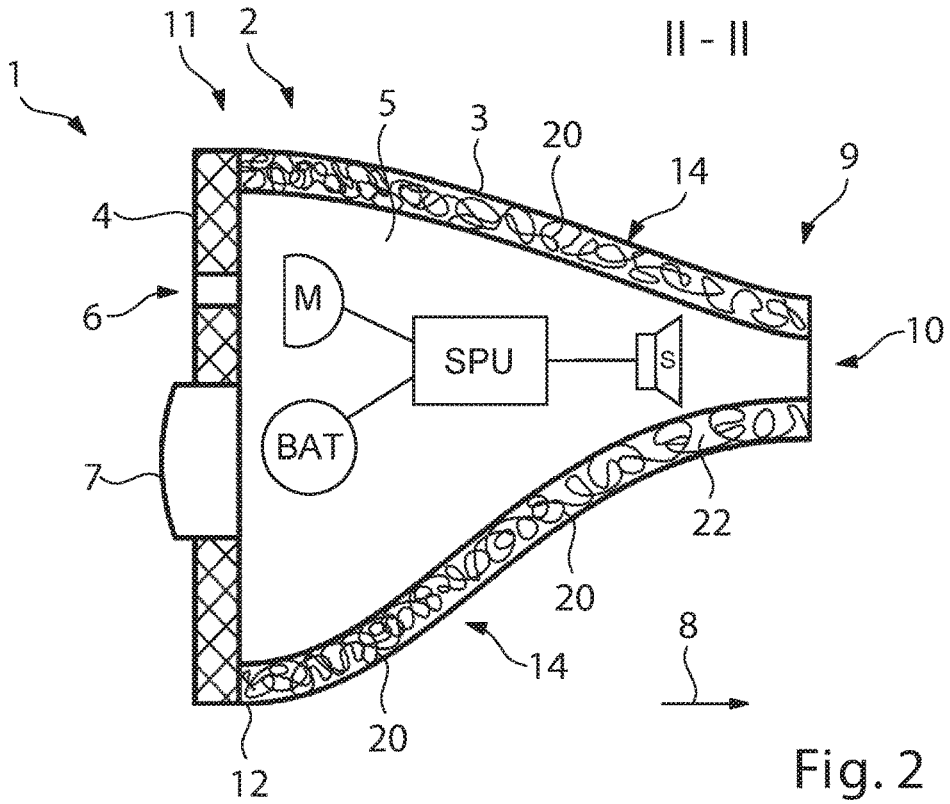
FIG. 2 is a schematic sectional view of an exemplary embodiment of the hearing device component taken along the section line II-II in FIG. 1.

In a further illustrative embodiment not shown in detail, and explained with reference to FIG. 2, provision is made that, in the infiltration of the fiber skeleton with the matrix material 22, the fiber skeleton is kept free in the region of the edge 12, such that in this region the fibers 20 lie free and are not embedded in the matrix material 22. The second housing part 4 is then affixed to the edge 12 by means of an adhesive. The adhesive penetrates into the exposed fiber skeleton and in so doing forms a cohesively bonded and also form-fit connection between the second housing part 4 and the first housing part 3.

Figure 3:
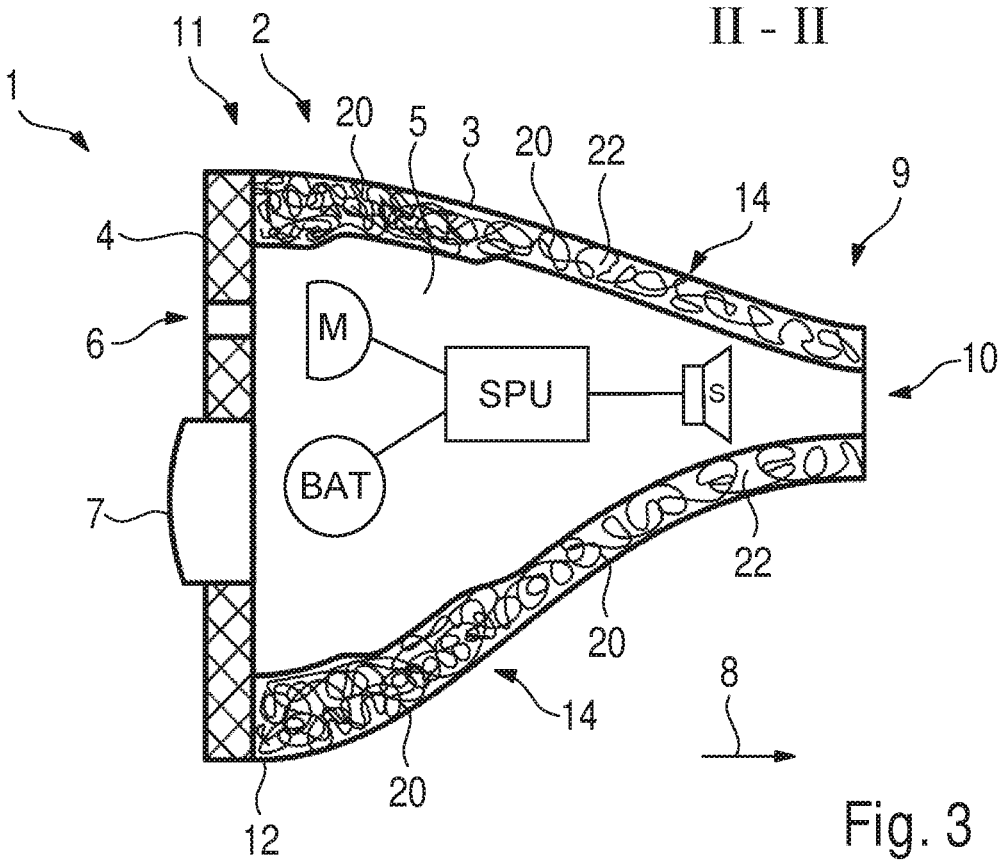
FIG. 3 is a similar view of an alternative embodiment of the invention.

With reference to FIG. 3, the hearing aid 1 houses hearing aid components in its interior 5. The hearing aid components include, at a minimum, a microphone M, a battery BAT, a (digital) signal processing unit SPU and a speaker S.

FIG. 3 shows a further illustrative embodiment in detail. The variation in the stiffness or flexibility of the first housing part 3, or of its wall 14, along the insertion direction 8 is here obtained through a combination of the geometric structure of the fiber skeleton and also the above-described variation in the fiber content of the fibers 20 along the insertion direction 8. Specifically, the housing part 3 has a wall thickness that decreases in steps in the insertion direction 8. The fiber content of the fibers 20 decreases, analogously to the illustrative embodiment described with reference to FIG. 2, likewise in the direction of the tip end 9.

In a further illustrative embodiment, the fibers 20 are not arranged by means of electro spinning and instead are formed as part of at least two semi-finished fiber products of different types. In this case, the first housing part 3 has at least two regions that are separated in a stepwise manner from each other in terms of the flexibility. For example, the different fiber semi-finished products are draped (for example wound or otherwise placed) onto a mold core and/or are shaped by means of a mold core replicating the housing interior 5, for example by thermoforming.

The subject matter of the invention is not limited to the above-described illustrative embodiments. Rather, further embodiments of the invention can be derived from the above description by a person skilled in the art. In particular, the individual features of the invention and the design variants thereof that have been described with reference to the various illustrative embodiments can also be combined with one another in another way.

The following is a summary list of reference symbols and the corresponding structure used in the above description of the invention:

1 hearing aid
2 housing
3 first housing part
4 second housing part
5 housing interior
6 microphone opening
7 battery compartment door
8 insertion direction
9 tip end
10 sound outlet opening
11 rear end
12 edge
14 wall
20 fiber
22 matrix material
M microphone
BAT battery
SPU (digital) signal processing unit
S loudspeaker

The invention claimed is:

1. A method of producing a housing part of a hearing device, the housing part having a housing interior for receiving at least one electronic component of the hearing device, the method comprising:

providing fibers for building up a fiber skeleton by varying a density of the fibers along an insertion direction of the hearing device, the fiber skeleton at least partially defining the housing interior; and infiltrating the fiber skeleton with a matrix material being a silicone, at least over a portion of a longitudinal extent thereof for defining a wall of the housing part.

2. The method according to claim 1, varying the flexibility of the wall in a predefined manner.

3. The method according to claim 2, wherein the flexibility of the wall increases in a predefined manner along the insertion direction.

4. The method according to claim 1, which comprises, building up the fiber skeleton so as to vary in terms of a geometric structure.

5. The method according to claim 1, wherein a material of the fibers is a thermoplastic.

6. The method according to claim 5, wherein the fibers are formed of a material selected from the group consisting of a polyamide and a polyether block amide.

7. The method according to claim 1, which comprises building up the fiber skeleton by electrospinning.

8. The method according to claim 1, which comprises building up the fiber skeleton from a woven and/or unwoven semi-finished product.

9. The method according to claim 1, which comprises keeping an end of the fiber skeleton free of matrix material, and forming an annular edge around the housing interior.

10. The method according to claim 9, which comprises closing the housing interior with a cover plate at the end of the housing part kept free of matrix material, and securing the cover plate to the wall of the housing part with adhesive by causing the adhesive to penetrate into the fiber skeleton that was kept free of the matrix material.

11. A method of producing a hearing device, the method comprising:

carrying out the method steps according to claim 1 for producing a housing part of the hearing device;

keeping an end of the fiber skeleton free of matrix material, and forming an annular edge around the housing interior;

closing the housing interior of the housing part with a cover plate at the end of the housing part kept free of matrix material; and securing the cover plate to the wall of the housing part by an adhesive and causing the adhesive to penetrate into the fiber skeleton kept free of the matrix material.

12. A hearing device, comprising a housing part produced by the method according to claim 1, wherein said housing part is to be worn in an auditory canal of a person and, seen in the direction of thickness, constitutes a sole external shell delimiting hearing device components of the hearing device from the auditory canal.

13. The hearing device according to claim 12, wherein an inner housing element is pushed into said housing part to enable a mounting of said hearing aid components.

* * * * *